US005141267A

United States Patent [19]

Vigreux

[11] Patent Number: 5,141,267

[45] Date of Patent: Aug. 25, 1992

[54] LOCKING FITTING FOR SLIDING LEAF OF DOORS, WINDOWS OR THE LIKE

[75] Inventor: Daniel Vigreux, Sarrebourg, France

[73] Assignee: Ferco International Usine de Ferrures de Batiment, Sarrebourg, France

[21] Appl. No.: 551,000

[22] Filed: Jul. 10, 1990

[30] Foreign Application Priority Data

Jul. 21, 1989 [FR] France ..... 89 10030

[51] Int. Cl.[5] ..... E05C 9/02; E05D 15/06

[52] U.S. Cl. ..... 292/95; 49/449; 292/DIG. 46

[58] Field of Search ..... 292/95, 175, DIG. 46; 49/449

[56] References Cited

U.S. PATENT DOCUMENTS

| | | | |
|---|---|---|---|
| 682,776 | 9/1901 | Zitzmann | 292/92 |
| 2,964,344 | 12/1960 | Rich | 292/DIG. 46 |
| 3,874,716 | 4/1975 | Bancroft | 292/175 |
| 4,643,005 | 2/1987 | Logas | 292/DIG. 46 |
| 4,973,091 | 11/1990 | Paulson et al. | 292/DIG. 46 |

FOREIGN PATENT DOCUMENTS

| | | | |
|---|---|---|---|
| 964937 | 3/1975 | Canada | 49/449 |

*Primary Examiner*—Renee S. Luebke
*Assistant Examiner*—D. Boucher
*Attorney, Agent, or Firm*—Sandler, Greenblum & Bernstein

[57] ABSTRACT

Locking fitting for a door, window or the like including a sliding leaf provided with a front stile having the shape of a "U"-shaped profile capable of fitting into a "U"-shaped profile forming the corresponding stile of the sash-frame when in a closed position. The bottom of each of these "U"-shaped profiles is capable of maintaining a distance between them so as to define a free space in which is positioned, at least one hook bolt integral with a movable actuating rod in a groove made in the "U"-shaped profile of the sliding leaf, and at least one keeper fixed in the bottom of the "U"-shaped profile of the sash-frame. The locking fitting includes at the actuating rod a mechanism to compensate, in the case of reduction of the cross-section of at least one of the "U"-shaped profiles of the sliding leaf or the sash-frame, for the decrease in the distance separating the bottom of the "U"-shaped profile corresponding to the sash-frame, in order to allow the introduction, into the free space of the at least one hook bolt and any cooperating keepers.

8 Claims, 4 Drawing Sheets

LOCKING FITTING FOR SLIDING LEAF OF DOORS, WINDOWS OR THE LIKE

BACKGROUND OF THE INVENTION

1. Field of the Invention

The invention relates to a locking fitting for a sliding leaf of a door, window or the like which includes a sliding leaf provided with a front stile having the shape of a "U"-shaped profile capable of fitting into a "U"-shaped profile forming the corresponding stile of the sash-frame in closing position of the door, window or the like, the bottom of each of these "U"-shaped profiles is designed to maintain a distance therebetween so as to define a free space in which is positioned at least a hook bolt integral with a movable actuating rod in a groove made in the "U"-shaped profile of the sliding leaf and actuated by an espagnolette or espagnolette-lock, and at least a keeper fixed in the bottom of the groove of the "U"-shaped profile of the sash-frame and capable of cooperating with the hook bolt in order to lock the sliding leaf. This invention will find its application in the field of the building ironmongery.

2. Discussion of Background and Material Information

In a door, window or the like, the sliding leaf of which is made of profiles having a "U"-shaped cross-section defining, on the periphery of the sliding leaf a groove having an which is oriented towards the sash-frame, it is necessary to take into consideration certain design parameters. There should exist a constant back-lash between the front edge of the parallel walls of the "U"-shaped profile forming the front stile of the sliding leaf and the bottom of the groove of the "U"-shaped profile which is also formed by the corresponding stile of the sash-frame. Such a condition being necessary in order to impede the leaf from coming to strike against the bottom of the groove of the "U"-shaped profile of the sash-frame.

It is also necessary to take into account the distance which separates, in closing position, the bottom of the groove of the "U"-shaped profile of the sliding leaf in which moves the actuating rod from the bottom of the groove of the "U"-shaped profile of the sash-frame onto which is fixed the keeper. In fact, this distance separating the bottoms of the aforementioned "U"-shaped profiles defines the space required to install the various members of the locking fitting.

In the case of fittings in fillisters, the use of traditional fittings is known. In these traditional fittings, the space may receive a keeper, as well as the corresponding locking member, which is mounted onto the front face of a rod. The rod is actuated in a groove in the front edge of the stile of the leaf. There is no problem as long as the space is sufficient and the fittings are adapted. These sliding openings have a certain weight and their profiles have important cross-sections, these types of leafs being intended for fitting openings allowing access to outside, have strength and endurance characteristics.

Still for this type of sliding leafs, there exist so-called light sliding leafs the cross-section of the profile of which, although having a morphology identical to the foregoing ones, is smaller. The space intended for the fittings is therefore reduced, so that same are characterized in that the rods comprise either openings receiving hook keepers or mushroom-shaped rollers which penetrate into openings made in the sash-frame. In that state of technique, the active face of the hook of the keeper comes to be located behind the rear face of the rod, in order to ensure the locking, or the contrary in the case of the mushroom-shaped rollers.

These fittings for light sliding leafs cannot be suited for more important constructions, since they do not allow to confer to same the strength and endurance characteristics: since the components of the fittings used are more fragile, these light sliding leafs are fitted into openings separating two rooms in a house.

In this situation, however, without reducing their quality, some manufacturers of the "U"-shaped profiles have proceeded to reduce their cross-section, in order to reduce the cost of the sliding leaf. This reduction in cross-section of the "U"-shaped profile of which the leaf is formed; is not detrimental to the constant back-lash between the edge of the profile of the sliding leaf and the bottom of the groove of the "U"-shaped profile of the sash-frame, but is detrimental to the distance, i.e., the space, between the bottom of the "U"-shaped profile of the sliding leaf in which moves the actuating rod and the bottom of the "U"-shaped profile corresponding to the sash-frame.

Thus, if it is desired to use traditional fittings, it is necessary to provide means allowing to compensate for this reduction of the cross-section of the "U"-shaped profile of the leaf.

In addition, since the keeper and the bolt should maintain a normal function to correctly and qualitatively ensure their locking characteristics, it is out of the question to diminish their strength by reducing either of them.

The object of this invention is to cope with all the aforementioned troubles.

SUMMARY OF THE INVENTION

The present invention overcomes the problem residing in providing a locking fitting for a door, window or the like, comprising a sliding leaf provided with a front stile having a "U"-shaped profile capable of fitting into a "U"-shaped profile forming the corresponding stile of the sash-frame. In closing position, the bottom of each of these "U"-shaped profiles maintains a distance between them so as to define a free space in which is positioned at least a hook bolt integral with a movable actuating rod in a groove made in the "U"-shaped profile of the sliding leaf and actuated by an espagnolette or espagnolette-lock, and at least a keeper fixed in the "U"-shaped profile of the sash-frame capable of cooperating with the hook bolt in order to lock the sliding leaf. This locking fitting includes, at the actuating rod means to compensate, in the case of reduction of the cross-section of at least one of the "U"-shaped profiles of the sliding leaf or the sash-frame, for the reduction of the distance separating the bottom of the "U"-shaped profile of the sliding leaf from the bottom of the "U"-shaped profile corresponding to the sash-frame, in order to allow the introduction into the so defined free space of the hook bolt and the cooperating keeper.

The advantages resulting from this invention mainly resides in the fact that it is possible to maintain all components of a traditional locking fitting in the framework of doors, windows or the like, even in a sliding leaf having a profile having a reduced-size "U"-shaped cross-section.

BRIEF DESCRIPTION OF THE DRAWINGS

The invention is described below more in detail, with reference to drawings showing only one embodiment.

DESCRIPTION OF THE PREFERRED EMBODIMENTS

Figure 1:
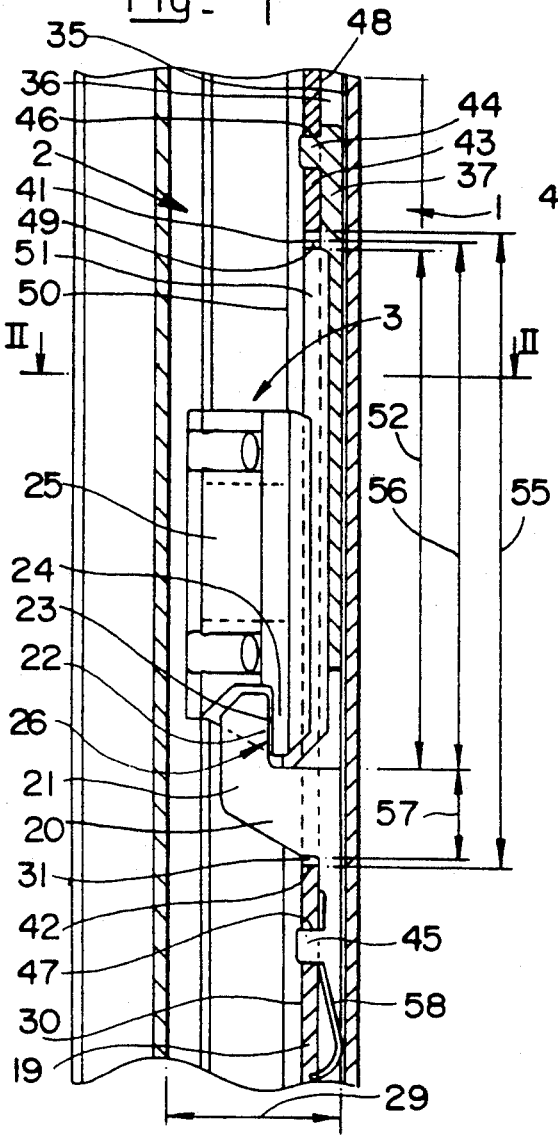
FIG. 1 is a partial elevational view at the level of a locking point, of a locking fitting according to a first embodiment of the invention, and fitted onto a sliding leaf having a profile with a "U"-shaped cross-section of which the front stile has one single vertical groove.

With reference to FIGS. 1 through 4, a window, door or the like, is illustrated which includes at least a sliding leaf 1, the frame of which is formed by metallic and/or plastic profiles having a "U"-shaped cross-section 5, and a sash-frame 2, the frame of which is also formed by metallic and/or plastic profiles with a similar cross-section 8. The window, door or the like is provided with a traditional locking fitting 3 permitting the locking of the sliding leaf 1.

When closing the window, door or the like, the front edge 4 of the "U"-shaped profile 5 of the front stile of the sliding leaf 1 engages into the space 6 present at the level of the front edge 7 of the "U"-shaped profile 8. The stroke of the sliding leaf 1 is such that, at the end of the stroke, there remains a backlash 9 between the front edge 4 of the "U"-shaped profile 5 of the sliding leaf 1 and the bottom 10 of the space 6 corresponding to the "U"-shaped profile 8 of the sash-frame 2, so that the flange 11 of the "U"-shaped profile 8 of the sash-frame 2 partly overlaps the external face 12 of the "U"-shaped profile 5 of the sliding leaf 1.

Furthermore, the front edge 4 of the "U"-shaped profile 5 of the sliding leaf 1 includes a vertical groove 13 defined with respect to the front edge 4 by a spacer 14 forming the bottom of the vertical groove 13 and by two vertical flanges 15, 16 parallel to the spacer 14.

Figure 3:
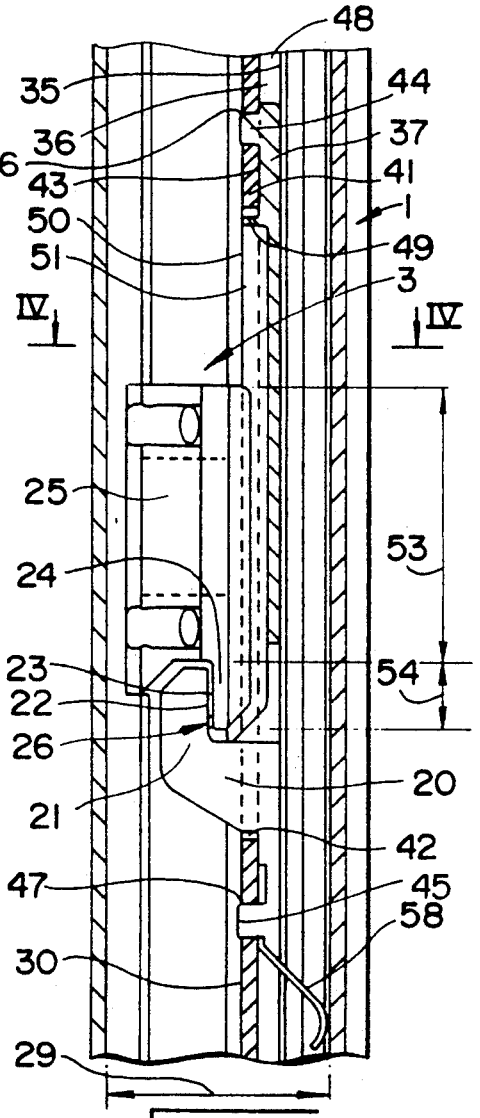
FIG. 3 is a partial elevational view, at the level of a locking point, of a locking fitting according to a second embodiment of the invention, and fitted onto a sliding leaf having a profile with a "U"-shaped cross-section of which the front stile has two vertical spaces
Figure 2:
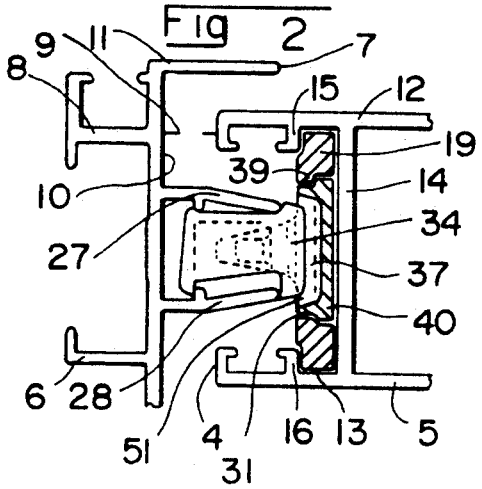
FIG. 2 is a cross-sectional view taken along line II—II in FIG. 1.
Figure 4:
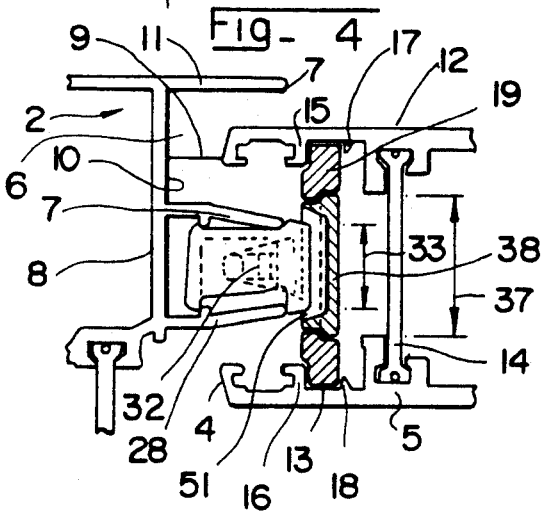
FIG. 4 is a cross-sectional view taken along line IV—IV in FIG. 3.
Figure 5:
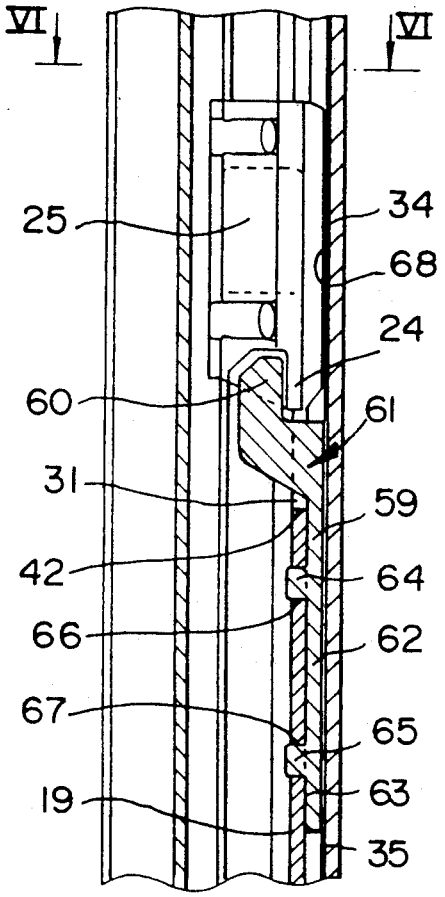
FIG. 5 is a partial elevational view, at the level of a locking point, of a locking fitting according to a third embodiment the invention, and fitted onto a sliding leaf having a profile with a "U"-shaped cross-section of which the front stile includes one single vertical groove.
Figure 7:
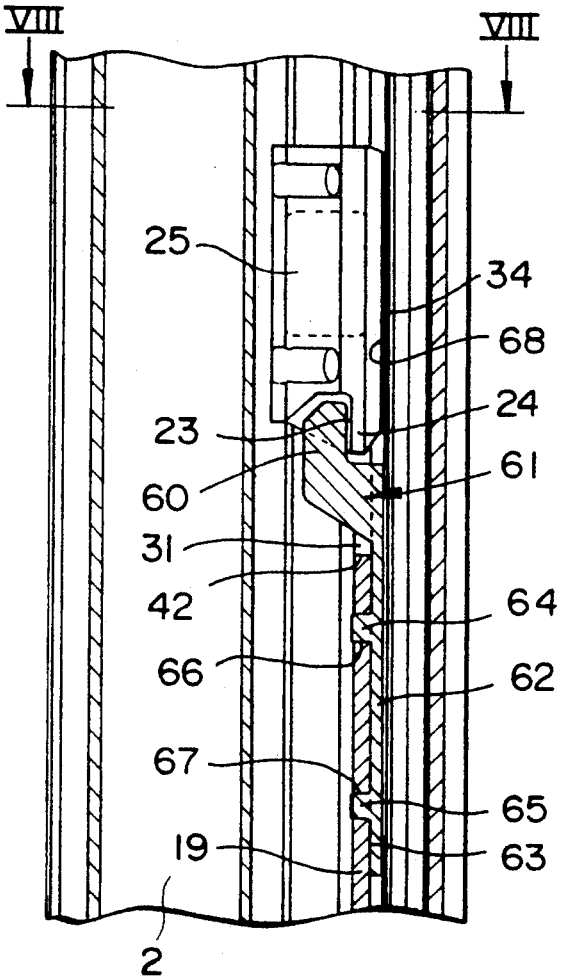
FIG. 7 is a partial elevation view, at the level of a locking point, of a locking fitting according to a fourth embodiment of the invention and fitted onto a sliding leaf having a profile with a "U"-shaped cross-section of which the front stile has two vertical spaces.
Figure 6:
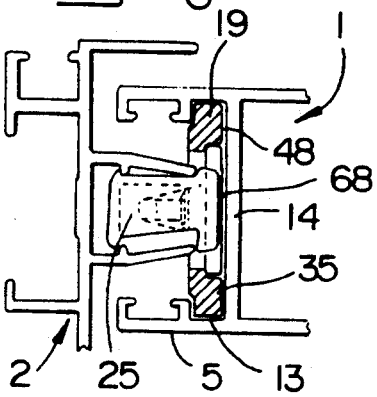
FIG. 6 is a cross-sectional view taken along line V—V in FIG. 5.
Figure 8:
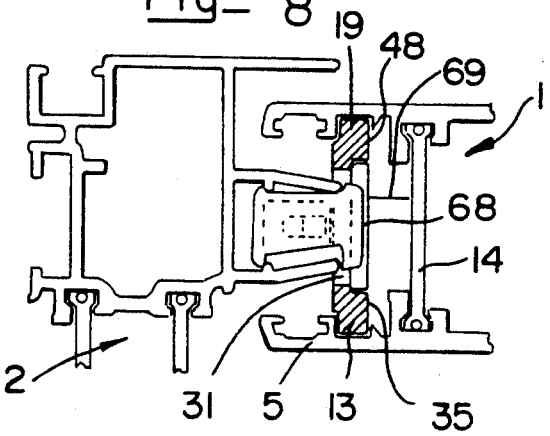
FIG. 8 is a cross-sectional view taken along line VII—VII in FIG. 7.
Figure 9:
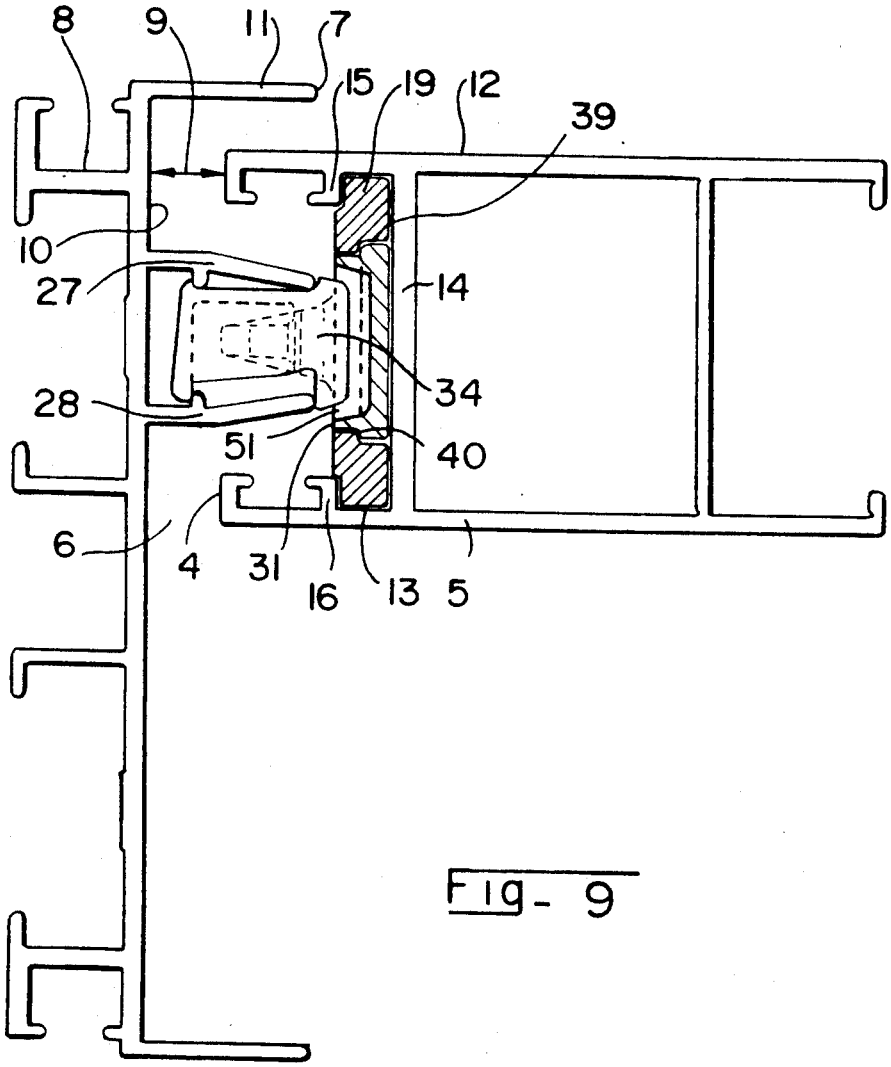
FIG. 9 is a partial elevational view, at a level of a locking point, of a locking fitting similar to FIG. 1, but illustrating the entire "U"-shaped profile of the sash frame.
Figure 10:
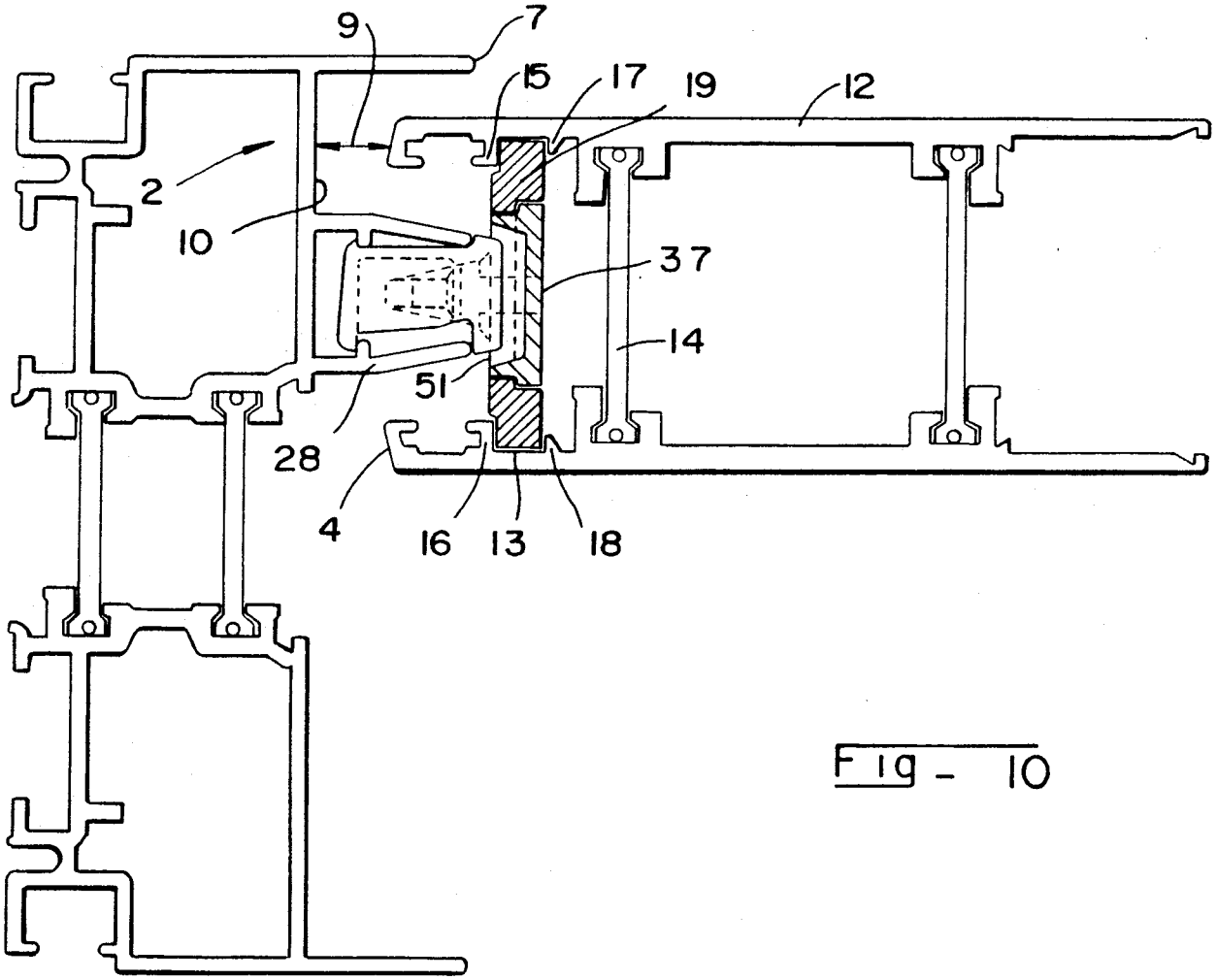
FIG. 10 is a partial elevational view, at a level of a locking point, of a locking fitting similar to FIG. 3, but illustrating the entire "U"-shaped profile of the sash frame.

According to another embodiment, shown in FIGS. 3 and 4, the vertical groove 13 comprises, besides the vertical flanges 15, 16, a second pair of vertical flanges 17, 18 parallel to and arranged between the vertical flanges 15, 16 and the spacer 14.

In the vertical groove 13 slides an actuating rod 19 actuated by an espagnolette or espagnolette-lock (not shown) engaged from the front edge 4 into the "U"-shaped profile 5 of the sliding leaf 1.

This actuating rod 19 transmits rectilinear motion, which is conferred thereto by the espagnolette or espagnolette-lock, to hook bolts 20. The hook bolts 20 include an active face 22 on hook 21 which cooperates with an active face 23 of a hook 24 of keeper 25. Such structure permits hooking in areas 26, the number of which is of course dependent upon the number of hook bolts and on the number of keepers 25. These keepers 25 are arranged between two vertical flanges 27, 28 projecting with respect to the bottom 10 of the space 6 of the front edge 7 of the "U"-shaped profile 8 of the sash-frame 2.

Now, frequently, for particular reasons, among others for savings' sake, the cross-section of the "U"-shaped profile 5 of the sliding leaf 1 is reduced, which reduces the free space 29 between the bottom 10 of the space 6 of the "U"-shaped profile 8 of the sash-frame 2 and the bottom 14 of the vertical groove 13 of the "U"-shaped profile 5 of the sliding leaf 1. The traditional locking fitting should however be incorporated into this reduced free space 29 without diminishing the strength of either the hook bolts 20 or the keepers 25.

For this purpose, the invention comprises, at the level of the actuating rod 19, means permitting a compensation in the reduction of the free space 29, in order to be able to keep hook bolts 20 and keepers 25 within standard sizes conferring the locking a good safety. More particularly, the actuating rod 19 is made from flat metal wires (not shown in the figures) or profiles such as shown in FIGS. 2, 4, 6 and 8.

According to a first embodiment, the compensation means consist in making, in the actuating rod 19, at the various locations of the hooking-in areas 26, a vertical opening 31, the width 32 of which is at least equal to the width 33 of the front part 34 of the keepers 25, so that this front part 34 may be able to penetrate into the actuating rod 19.

When the actuating rod 19 is formed of a flat metal wire, it is necessary to suppress the weakness of this actuating rod at the vertical opening 31. For this purpose, the hook bolt 20 comprises a body 37 extending beyond the upper edge 41, and the lower edge 42 of the vertical opening 31. Thus, the body 37 of the hook bolt 20 ensures a good rigidity at both lateral edges of the vertical opening 31. The front face 43 of the body 37 is provided with two studs 44, 45 engaging into openings 46, 47 made in the rear face 35 of the actuating rod and acting as connecting members between the hook bolt 20 and the actuating rod 19. According to the invention, it is provided that the front part 34 of the keeper 25 penetrates into the actuating rod 19. For this purpose, in the front face 50 of the rectangular boss 49 is made a recess 51 into which penetrates the front part 34 of the keeper 25. The height 52 of this recess 51 corresponds at least to the sum of the height 53 of the keeper 25 and the value of the stroke 54 of the actuating rod 19 ensuring the dissolution of the cooperation between the active face 22 of the hook 21 of the hook bolt 20 and the active face 23 of the hook 24 of the keeper 25. Of course, the height 55 of the vertical opening 31 is at least equal to the sum of the height 56 of the rectangular boss 49 and the height 57 of the hook 21.

When the actuating rods 19 are formed by a profile, this profile has a "C" or "U"-shaped cross-section, so that the actuating rod 19 naturally has on its rear face 35 a vertical groove serving as a recess for the body 37 of the hook bolt 20.

The width 38 of this vertical groove 36 or these vertical groove segments is slightly larger than the width 32 of the vertical opening 31, so that two shoulders 39, 40 are obtained, against which rests the body 37 of the hook bolt 20.

This vertical groove 36 serves as a recess for a second positioning means.

With reference to FIGS. 5 through 8, which illustrate further embodiments of the present invention, The hook bolt 59 comprises a hook 60 located at the upper end 61 of the body 62. Hence, this latter is located at the lower edge 42 of the vertical opening 31 of the actuating rod 19 and comprises, on its front face 63, two studs 64, 65 coming to be housed in the openings 66, 67 made in the actuating rod 19.

In these embodiments the front edge 68 of the keeper 25 can be flush with the rear face of the actuating rod 19.

Thus, the presence of the boss 49 and the recess 51 of the foregoing embodiments of the hook bolt 20 is suppressed. Both means allowing to obtain positions of the active area which are more or less deep with respect to the bottom 14 of the grooves 13 of the "U"-shaped profile 5 of the sliding leaf 1.

The front part 34 of the keeper 25 may indeed completely pass through the vertical opening 31 of the actuating rod 19, so that the front part of the hook 24 of the keeper 25 comes to be located anew in the space 69 located between the rear face 35 of the actuating rod 19 and the spacer 14 of the "U"-shaped profile 5 of the sliding leaf 1.

As illustrated in FIGS. 1 and 3, in order to ensure the connection between the hook bolt 20 and the actuating rod 19, flexible members 58 are provided, which are pulled over the studs 45 and interposed between the bottom 48 of the vertical groove 36 of the actuating rod 19 and the bottom 14 of the "U"-shaped profile 5 of the sliding leaf 1. Hence, any vibration of the hook bolt 20 during its movement in the groove 13 of the "U"-shaped profile 5 of the sliding leaf 1 is suppressed.

I claim:

1. Locking fitting for a sliding leaf, comprising:

a sliding leaf including a front stile having a "U"-shaped profile, and a sash-frame having a "U"-shaped profile into which said "U"-shaped profile of said sliding leaf is capable of fitting, said "U"-shaped profile of said sliding leaf and said "U"-shaped profile of said sash-frame including a bottom portion which, in a closed position of the sliding leaf, are separated by a distance so as to define a free space;

at least one hook bolt and at least one keeper being positioned within said free space, said at least one hook bolt being integral with a movable actuating rod in a groove in said "U"-shaped profile of said sliding leaf, and said at least one keeper being fixed in said "U"-shaped profile of said sash-frame, said keeper engages and disengages from said at least one hook bolt to permit locking and unlocking of said sliding leaf; and means for compensating associated with said actuating rod to permit a reduction in the distance separating the bottom of said "U"-shaped profile of said sliding leaf from the bottom of said "U"-shaped profile corresponding to said sash-frame, in order to allow introduction into said free space of said at least one hook bolt and said at least one keeper.

2. Locking fitting according to claim 1, wherein, in a closed position, said at least one hook bolt and said at least one keeper contact each other at at least one hooking area; said means for compensating comprise at least one vertically oriented opening in said actuating rod located at the at least one hooking area; said at least one keeper comprises a front part having a width which is capable of being engaged in the closed position into the vertically oriented opening of said actuating rod; and the vertically oriented opening has a width at least equal to the width of a front part of said at least one keeper.

3. Locking fitting according to claim 2, wherein said vertically oriented opening has a height defined by an upper edge and a lower edge; said means for compensating further include said at least one hook bolt comprising a body extending beyond said upper edge and said lower edge of said vertically oriented opening; and said body of said at least one hook bolt includes a front face provided with a rectangular boss having a front portion including a recess.

4. Locking fitting for a sliding leaf, comprising:

a sliding leaf including a front stile having a "U"-shaped profile, and a sash-frame having a "U"-shaped profile into which said "U"-shaped profile of said sliding leaf is capable of fitting, said "U"-shaped profile of said sliding leaf and said "U"-shaped profile of said sash-frame including a bottom portion which, in a closed position of the sliding leaf, are separated by a distance so as to define a free space;

at least one hook bolt and at least one keeper being positioned within said free space, said at least one hook bolt being integral with a movable actuating rod in a groove in said "U"-shaped profile of said sliding leaf, and said at least one keeper being fixed in said "U"-shaped profile of said sash-frame and being capable of cooperating with said at least one hook bolt to permit locking of said sliding leaf; and means for compensating associated with said actuating rod to permit a reduction in the distance separating the bottom of said "U"-shaped profile of said sliding leaf from the bottom of said "U"-shaped profile corresponding to said sash-frame, in order to allow introduction into said free space of said at least one hook bolt and said at least one keeper, in a closed position, said at least one hook bolt and said at least one keeper contact each other at at least one hooking area; said means for compensating comprise at least one vertically oriented opening in said actuating rod located at said at least one hooking area; said at least one keeper comprises a front part having a width which is capable of being engaged in the closed position into the vertically oriented opening of said actuating rod; and the vertically oriented opening has a width at least equal to the width of said front part of said at least one keeper, and a height defined by an upper edge and a lower edge; said means for compensating further include said at least one hook bolt comprising a body extending beyond said upper edge and said lower edge of said vertically oriented opening; and said body of said at least one hook bolt includes a front face provided with a rectangular boss having a front portion including a recess, said rectangular boss has a first height, a hook of said at least one hook bolt has a second height, said height of said vertically oriented opening is at least equal to the sum of the height of the rectangular boss and the height of the hook, and said rectangular boss and said hook pentrate into said vertically oriented opening.

5. Locking fitting for a sliding leaf, comprising:

a sliding leaf including a front stile having a "U"-shaped profile, and a sash-frame having a "U"-shaped profile into which said "U"-shaped profile of said sliding leaf is capable of fitting, said "U"-shaped profile of said sliding leaf and said "U"-shaped profile of said sash-frame including a bottom portion which, in a closed position of the sliding leaf, are separated by a distance so as to define a free space;

at least one hook bolt and at least one keeper being positioned within said free space, said at least one hook bolt being integral with a movable actuating rod in a groove in said "U"-shaped profile of said sliding leaf, and said at least one keeper being fixed in said "U"-shaped profile of said sash-frame, said keeper engages and disengages from said at least one hook bolt to permit locking and unlocking of said sliding leaf; and means for compensating associated with said actuating rod to permit a reduction in the distance separating the bottom of said "U"-shaped profile of said sliding leaf from the bottom of said "U"-shaped profile corresponding to said sash-frame, in order to allow introduction into said free space of said at least one hook bolt and said at least one keeper, in a closed position, said at least one hook bolt and said at least one keeper contact each other at at least one hooking area; said means for compensating comprise at least one vertically oriented opening in said actuating rod located at said at least one hooking area; said at least one keeper comprises a front part having a width which is capable of being engaged in the closed position into the vertically oriented opening of said actuating rod; and the vertically oriented opening has a width at least equal to the width of said front part of said at least one keeper, and a height defined by an upper edge and a lower edge; said means for compensating further include said at least one hook bolt comprising a body extending beyond said upper edge and said lower edge of said vertically oriented opening; and said body of said at least one hook bolt includes a front face provided with a rectangular boss having a front portion including a recess, said recess within said front portion of said rectangular boss of said body of said at least one hook bolt has a width which is greater than or equal to said width of said front part of said at least one keeper.

6. Locking fitting for a sliding leaf, comprising:

a sliding leaf including a front stile having a "U"-shaped profile, and a sash-frame having a "U"-shaped profile into which said "U"-shaped profile of said sliding leaf is capable of fitting, said "U"-shaped profile of said sliding leaf and said "U"-shaped profile of said sash-frame including a bottom protion which, in a closed position of the sliding leaf, are separated by a distance so as to define a free space;

at least one hook bolt and at least one keeper being positioned within said free space, said at least one hook bolt being integral with a movable actuating rod in a groove in said "U"-shaped profile of said sliding leaf, and said at least one keeper being fixed in said "U"-shaped profile of said sash-frame and being capable of cooperating with said at least one hook bolt to permit locking of said sliding leaf; and means for compensating associated with said actuating rod to permit a reduction in the distance separating the bottom of said "U"-shaped profile of said sliding leaf from the bottom of said "U"-shaped profile corresponding to said sash-frame, in order to allow introduction into said free space of said at least one hook bolt and said at least one keeper, in a closed position, said at least one hook bolt and said at least one keeper contact each other at at least one hooking area; said means for compensating comprise at least one vertically oriented opening in said actuating rod located at said at least one hooking area; said at least one keeper comprises a front part having a width which is capable of being engaged in the closed position into the vertically oriented opening of said actuating rod; and the vertically oriented opening has a width at least equal to the width of said front part of said at least one keeper, and a height defined by an upper edge and a lower edge; said means for compensating further include said at least one hook bolt comprising a body extending beyond said upper edge and said lower edge of said vertically oriented opening; and said body of said at least one hook bolt includes a front face provided with a rectangular boss having a front portion including a recess, said at least one hook bolt is movable over a predetermined stroke, and said recess within said front portion of said rectangular boss has a height at least equal to the sum of the height of said at least one keeper and the predetermined stroke of said at least hook bolt.

7. Locking fitting for a sliding leaf, comprising:

a sliding leaf including a front stile having a "U"-shaped profile, and a sash-frame having a "U"-shaped profile into which said "U"-shaped profile of said sliding leaf is capable of fitting, said "U"-shaped profile of said sliding leaf and said "U"-shaped profile of said sash-frame including a bottom portion which, in a closed position of the sliding leaf, are separated by a distance so as to define a free space;

at least one hook bolt and at least one keeper being positioned within said free space, said at least one hook bolt being integral with a movable actuating rod in a groove in said "U"-shaped profile of said sliding leaf, and said at least one keeper being fixed in said "U"-shaped profile of said sash-frame and being capable of cooperating with said at least one hook bolt to permit locking of said sliding leaf; and means for compensating associated with said actuating rod to permit a reduction in the distance separating the bottom of said "U"-shaped profile of said sliding leaf from the bottom of said "U"-shaped profile corresponding to said sash-frame, in order to allow introduction into said free space of said at least one hook bolt and said at least one keeper, in a closed position, said at least one hook bolt and said at least one keeper contact each other at least one hooking area; said means for compensating comprise at least one vertically oriented opening in said actuating rod located at said at least one hooking area; said at least one keeper comprises a front part having a width which is capable of being engaged in the closed position into the vertically oriented opening of said actuating rod, said actuating rod includes a rear edge having a vertical groove along said vertically oriented opening, and said at least one hook bolt is housed in said vertical groove.

8. Locking fitting for a sliding leaf, comprising:

a sliding leaf including a front stile having a "U"-shaped profile, and a sash-frame having a "U"-shaped profile into which said "U"-shaped profile of said sliding leaf is capable of fitting, said "U"-shaped profile of said sliding leaf and said "U"-shaped profile of said sash-frame including a bottom portion which, in a closed position of the sliding leaf, are separated by a distance so as to define a free space;

at least one hook bolt and at least one keeper being positioned within said free space, said at least one hook bolt being integral with a movable actuating rod in a groove in said "U"-shaped profile of said sliding leaf, and said at least one keeper being fixed in said "U"-shaped profile of said sash-frame and being capable of cooperating with said at least one hook bolt to permit locking of said sliding leaf; and means for compensating associated with said actuating rod to permit a reduction in the distance separating the bottom of said "U"-shaped profile of said sliding leaf from the bottom of said "U"-shaped profile corresponding to said sash-frame, in order to allow introduction into said free space of said at least one hook bolt and said at least one keeper, in a closed position, said at least one hook bolt and said at least one keeper contact each other at at least one hooking area; said means for compensating comprise at least one vertically oriented opening in said actuating rod located at said at least one hooking area; said at least one keeper comprises a front part having a width which is capable of being engaged in the closed position into the vertically oriented opening of said actuating rod; and the vertically oriented opening has a width at least equal to the width of said front part of said at least one keeper, and a height defined by an upper edge and a lower edge; said means for compensating further include said at least one hook bolt comprising a body extending beyond said upper edge and said lower edge of said vertically oriented opening; and said body of said at least one hook bolt includes a front face provided with a rectangular boss having a front portion including a recess, said body of said at least one hook bolt extends under said lower edge of said vertically oriented opening and comprises at least one stud for connecting said at least one hook bolt with said actuating rod.

* * * * *